US009273650B2

(12) United States Patent
Born et al.

(10) Patent No.: US 9,273,650 B2
(45) **Date of Patent: *Mar. 1, 2016**

(54) SYSTEM FOR IMPROVING GAS DISTRIBUTION IN AN INTAKE MANIFOLD

(75) Inventors: David Born, Commerce Township, MI (US); Nolan Dickey, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 214 days.

This patent is subject to a terminal disclaimer.

(21) Appl. No.: 13/483,353

(22) Filed: May 30, 2012

(65) Prior Publication Data

US 2012/0234303 A1 Sep. 20, 2012

Related U.S. Application Data

(63) Continuation of application No. 12/767,519, filed on Apr. 26, 2010, now Pat. No. 8,191,525.

(51) Int. Cl.
*F02M 35/10* (2006.01)
*F02M 35/116* (2006.01)

(52) U.S. Cl.
CPC ... *F02M 35/10019* (2013.01); *F02M 35/10045* (2013.01); *F02M 35/10052* (2013.01); *F02M 35/10111* (2013.01); *F02M 35/10229* (2013.01); *F02M 35/116* (2013.01)

(58) Field of Classification Search
USPC ..... 123/527, 184.21, 184.23, 184.32, 123/184.39, 184.46, 572, 574, 41.86
See application file for complete search history.

(56) References Cited

U.S. PATENT DOCUMENTS

| | | | | |
|---|---|---|---|---|
| 1,785,632 | A | 12/1930 | Klima | |
| 3,731,665 | A | 5/1973 | Garcea | |
| 4,308,840 | A | 1/1982 | Hiramatsu et al. | |
| 4,705,007 | A | 11/1987 | Plapp et al. | |
| 5,231,963 | A | 8/1993 | Perkins | |
| 5,535,717 | A * | 7/1996 | Rygiel | 123/306 |
| 5,722,357 | A * | 3/1998 | Choi | 123/184.21 |
| 6,343,583 | B1 * | 2/2002 | Nishida | F02M 25/0721 123/184.38 |
| 6,474,364 | B2 | 11/2002 | Ta et al. | |
| 6,810,863 | B2 * | 11/2004 | Memmott et al. | 123/527 |
| 7,299,787 | B2 * | 11/2007 | Sasaki et al. | 123/337 |
| 7,815,164 | B2 * | 10/2010 | Dong et al. | 251/121 |
| 2003/0010309 | A1 * | 1/2003 | Tsukii et al. | 123/184.42 |
| 2004/0231325 | A1 * | 11/2004 | Nichols | 60/297 |
| 2004/0255912 | A1 * | 12/2004 | Veinotte et al. | 123/520 |
| 2006/0005892 | A1 | 1/2006 | Kuo | |
| 2011/0005488 | A1 * | 1/2011 | Reese et al. | 123/184.61 |

FOREIGN PATENT DOCUMENTS

| | | | |
|---|---|---|---|
| JP | 2009057844 | A | 3/2009 |
| WO | 9714883 | A1 | 4/1997 |

* cited by examiner

*Primary Examiner* — Hung Q Nguyen
*Assistant Examiner* — Ruben Picon-Feliciano
(74) *Attorney, Agent, or Firm* — Greg Brown; Alleman Hall McCoy Russell & Tuttle LLP

(57) ABSTRACT

A system for improving distribution of gases within an intake manifold of an engine is presented. The system may be used to improve engine air-fuel control. In one example, turbulence of gases entering an intake manifold is increased.

18 Claims, 11 Drawing Sheets

SYSTEM FOR IMPROVING GAS DISTRIBUTION IN AN INTAKE MANIFOLD

CROSS REFERENCE TO RELATED APPLICATIONS

The present application is a continuation of U.S. patent application Ser. No. 12/767,519 filed Apr. 26, 2010, the entire contents of which are incorporated herein by reference for all purposes.

FIELD

The present description relates to a system for improving vapor distribution within an intake manifold of an engine. The system may be particularly useful for engines that have intake port runners with a bell mouth configuration.

BACKGROUND AND SUMMARY

An intake manifold of an engine may be configured to receive gases and provide vacuum to devices external the intake manifold. In one example, fuel vapors accumulated from a vehicle fuel system may be introduced to an intake manifold by way of a port. One system for distributing gases in an intake manifold is described in U.S. Pat. No. 7,299,787. This system provides for a gas introducing pipe that is upstream of a partitioning part, and the intake manifold is bifurcated by the part. Gases flowing from the gas introducing pipe are directed to a first or second group of cylinders by way of the partitioning plate.

The above-mentioned method can also have several disadvantages. Specifically, the intake manifold limits communication between cylinders of different cylinder banks and therefore may interfere with cylinder air flow during some conditions. Further, the intake manifold is more complex than other intake manifolds that have a common collector area between intake manifold runners. Further still, the intake manifold may be less suitable for engines that have a different cylinder firing order (e.g., eight cylinder engines).

The inventors herein have recognized the above-mentioned disadvantages and have developed an intake manifold for improving distribution of gases in an engine intake manifold.

One embodiment of the present description includes an intake manifold, comprising: a non-partitioned intake manifold coupled to an engine and including a common collector to which a plurality of intake runners are coupled; a first port located in said intake manifold and in an air flow path downstream of a throttle body and upstream of said plurality of intake runners; and a protrusion into said intake manifold downstream of said port and upstream of said plurality of intake runners.

By integrating a protrusion into an intake manifold, the intake manifold having a collector common to intake manifold runners, distribution of gases in an intake manifold may be improved without degrading engine performance. For example, a protrusion into an intake manifold at a location downstream of a gas inlet port and upstream of intake manifold runners can improve distribution of gases between the intake manifold runners. As a result, engine air-fuel control may be improved. Further, a protrusion can be designed into the intake manifold such that it has a limited affect on induction of gases into engine cylinders. Thus, engine cylinder air-fuel distribution may be improved without sacrificing engine power.

The present description may provide several advantages. In particular, the approach may improve engine emissions by improving cylinder air-fuel distribution. Further, cylinder air-fuel control may be improved while engine power is substantially unchanged. Further still, a protrusion may be formed in an intake manifold such that no additional components are necessary to improve engine cylinder air-fuel distribution.

The above advantages and other advantages, and features of the present description will be readily apparent from the following Detailed Description when taken alone or in connection with the accompanying drawings.

BRIEF DESCRIPTION OF THE DRAWINGS

The advantages described herein will be more fully understood by reading an example of an embodiment, referred to herein as the Detailed Description, when taken alone or with reference to the drawings, wherein.

DETAILED DESCRIPTION

Figure 1:
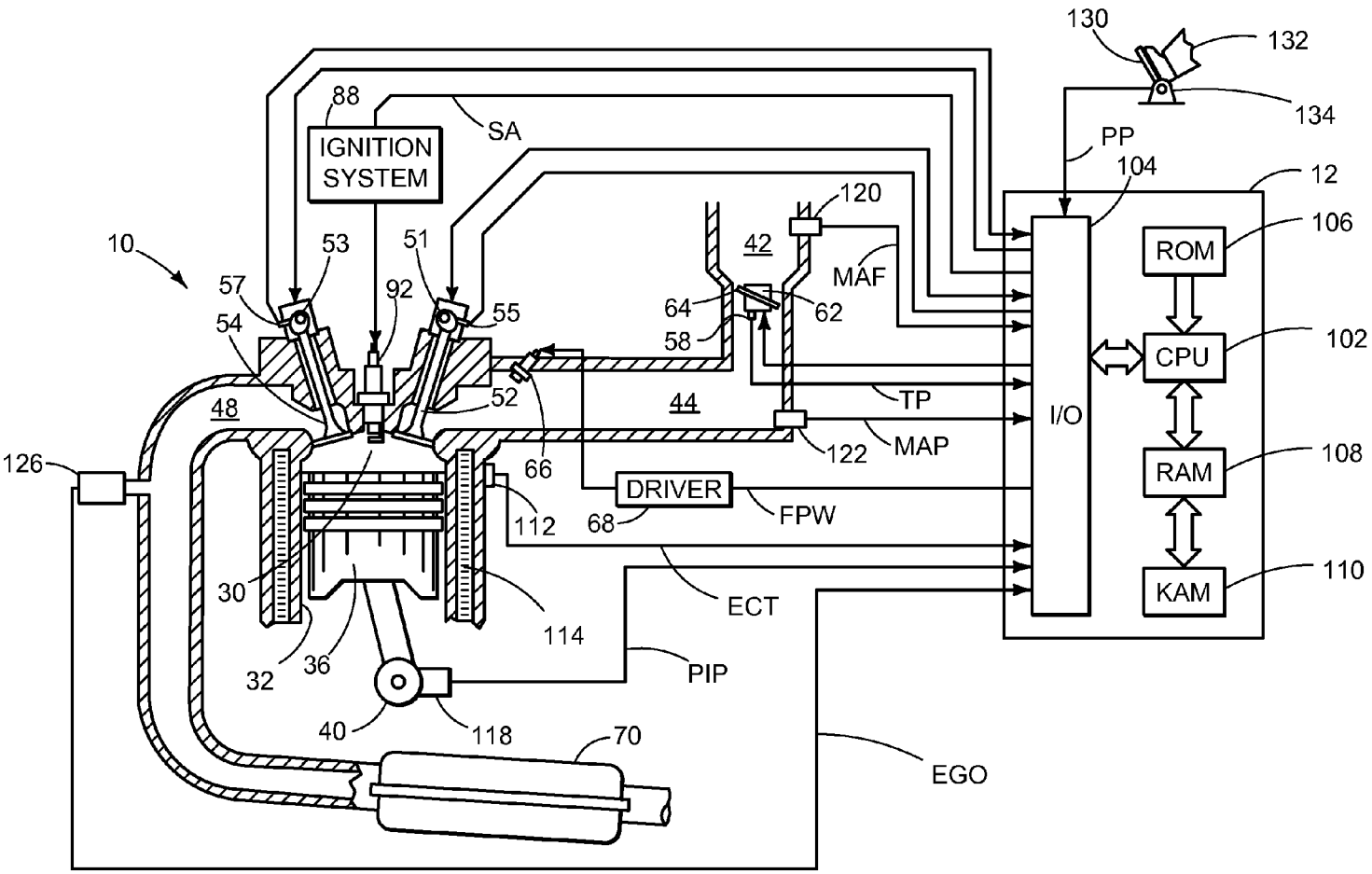
FIG. 1 is a schematic diagram of an engine.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. Alternatively, one or more of the intake and exhaust valves may be operated by an electromechanically controlled valve coil and armature assembly. The position of intake cam 51 may be determined by intake cam sensor 55. The position of exhaust cam 53 may be determined by exhaust cam sensor 57.

Intake manifold 44 is also shown intermediate of intake valve 52 and air intake zip tube 42. Fuel is delivered to fuel injector 66 by a fuel system (not shown) including a fuel tank, fuel pump, and fuel rail (not shown). The engine 10 of FIG. 1 is configured such that the fuel is injected to the cylinder intake port, which is known to those skilled in the art as port injection. Fuel injector 66 is supplied operating current from driver 68 which responds to controller 12. In addition, intake manifold 44 is shown communicating with optional electronic throttle 62 with throttle plate 64. In other embodiments, fuel may be injected directly into engine cylinders, which is known to those skilled in the art as direct injection. In one example, a low pressure direct injection system may be used, where fuel pressure can be raised to approximately 20-30 bar. Alternatively, a high pressure, dual stage, fuel system may be used to generate higher fuel pressures.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing force applied by foot 132; a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120; and a measurement of throttle position from sensor 58. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

In some embodiments, the engine may be coupled to an electric motor/battery system in a hybrid vehicle. The hybrid vehicle may have a parallel configuration, series configuration, or variation or combinations thereof.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

In one embodiment, the stop/start crank position sensor has both zero speed and bi-directional capability. In some applications a bi-directional Hall sensor may be used, in others the magnets may be mounted to the target. Magnets may be placed on the target and the "missing tooth gap" can potentially be eliminated if the sensor is capable of detecting a change in signal amplitude (e.g., use a stronger or weaker magnet to locate a specific position on the wheel). Further, using a bi-dir Hall sensor or equivalent, the engine position may be maintained through shut-down, but during re-start alternative strategy may be used to assure that the engine is rotating in a forward direction.

Figure 2:
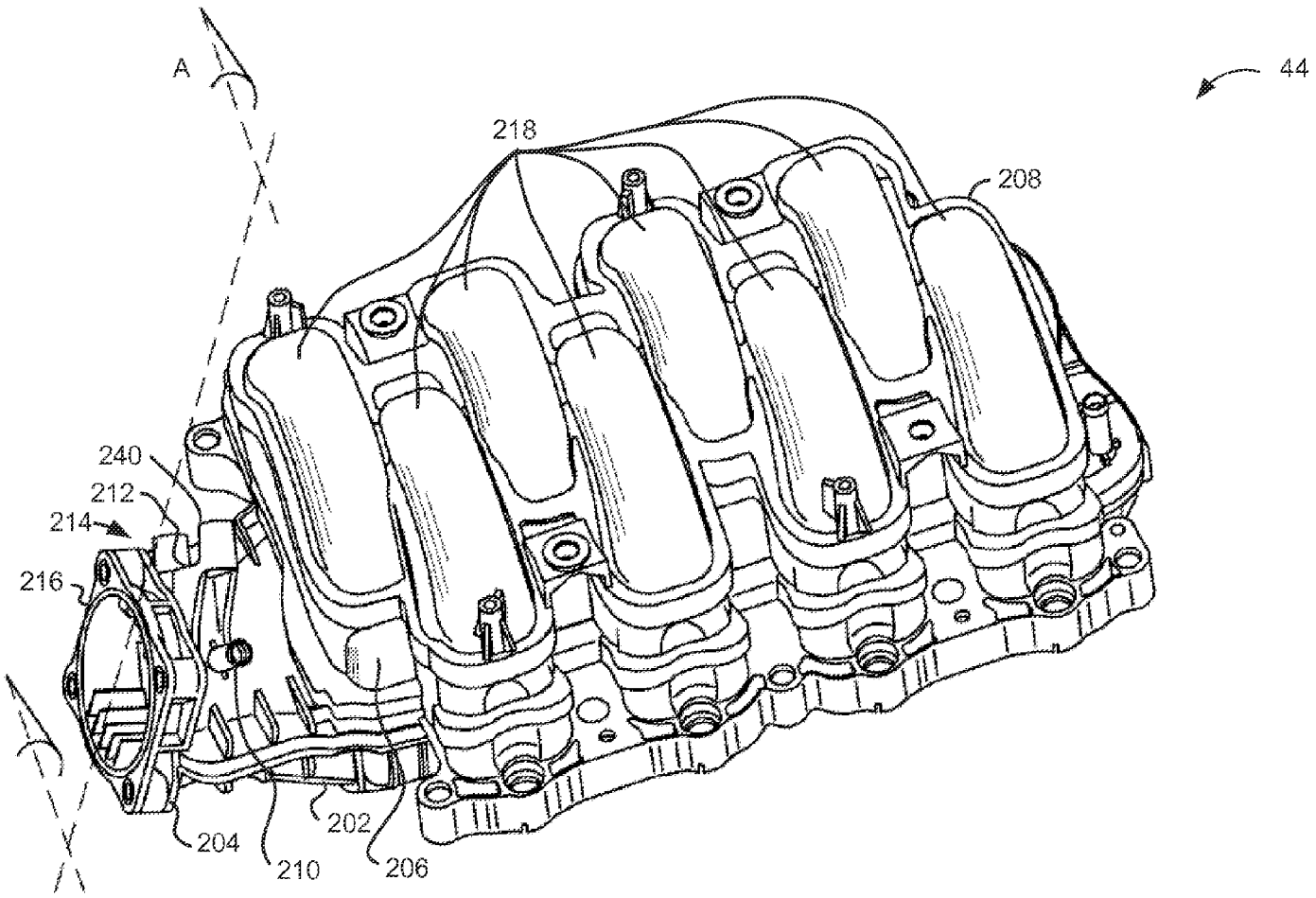
FIG. 2 is a schematic of an engine intake manifold assembly.

Referring now to FIG. 2, a schematic of an example engine intake manifold assembly is shown. Cutting plane A identifies the basis for sectional views shown in FIG. 8.

Intake manifold assembly 44 is configured to supply air to a V8 engine and is comprised of intake manifold plenum shell 202, intake manifold lower shell 204, intake manifold middle shell 206, and intake manifold upper shell 208. Thus, intake manifold 44 is comprised of four composite molded sections. The sections are welded together. In other embodiments fasteners (not shown) and gaskets may be used to couple the manifold sections.

Intake manifold lower shell 204 includes a brake boost port 210, a fuel purge port 212, and a positive crankcase ventilation (PCV) port 214. A purge control valve (not shown) is coupled to intake manifold lower shell at mounting bosses 240 to reduce delay of purge vapors flowing into the intake manifold. However, the purge valve may be mounted remotely from the intake manifold in other applications. The position of the purge control valve, the gas concentration, and the intake manifold vacuum determine the flow rate of gases from the fuel tank or vacuum canister to the engine. Brake boost port 210 provides engine vacuum to assist the operator supplying force to vehicle brakes. Fuel purge port 212 draws fuel vapors from the vehicle fuel tank and a fuel vapor storage canister into the engine under some engine operating conditions. For example, fuel vapors may be drawn into the engine at part-throttle conditions. PCV port 214 draws gases from the engine crankcase into engine cylinders to be combusted, thereby reducing emissions of hydrocarbons.

Intake manifold lower shell 204 includes a throttle body mounting flange 216 for coupling a throttle body (not shown) to intake manifold assembly 44. The throttle body effective area may be increased and decreased to allow the engine air amount to meet operator demands by opening and closing a throttle valve. The intake manifold plenum shell 202 and intake manifold lower shell 204 form an intake air collector (See FIG. 8) from which air is distributed to engine cylinders. Intake manifold middle shell 206 and intake manifold upper shell 208 combine to form intake runners 218 for individually distributing air from the intake air collector to the individual engine cylinders by way of ports in the cylinder heads (not shown).

Figure 3:
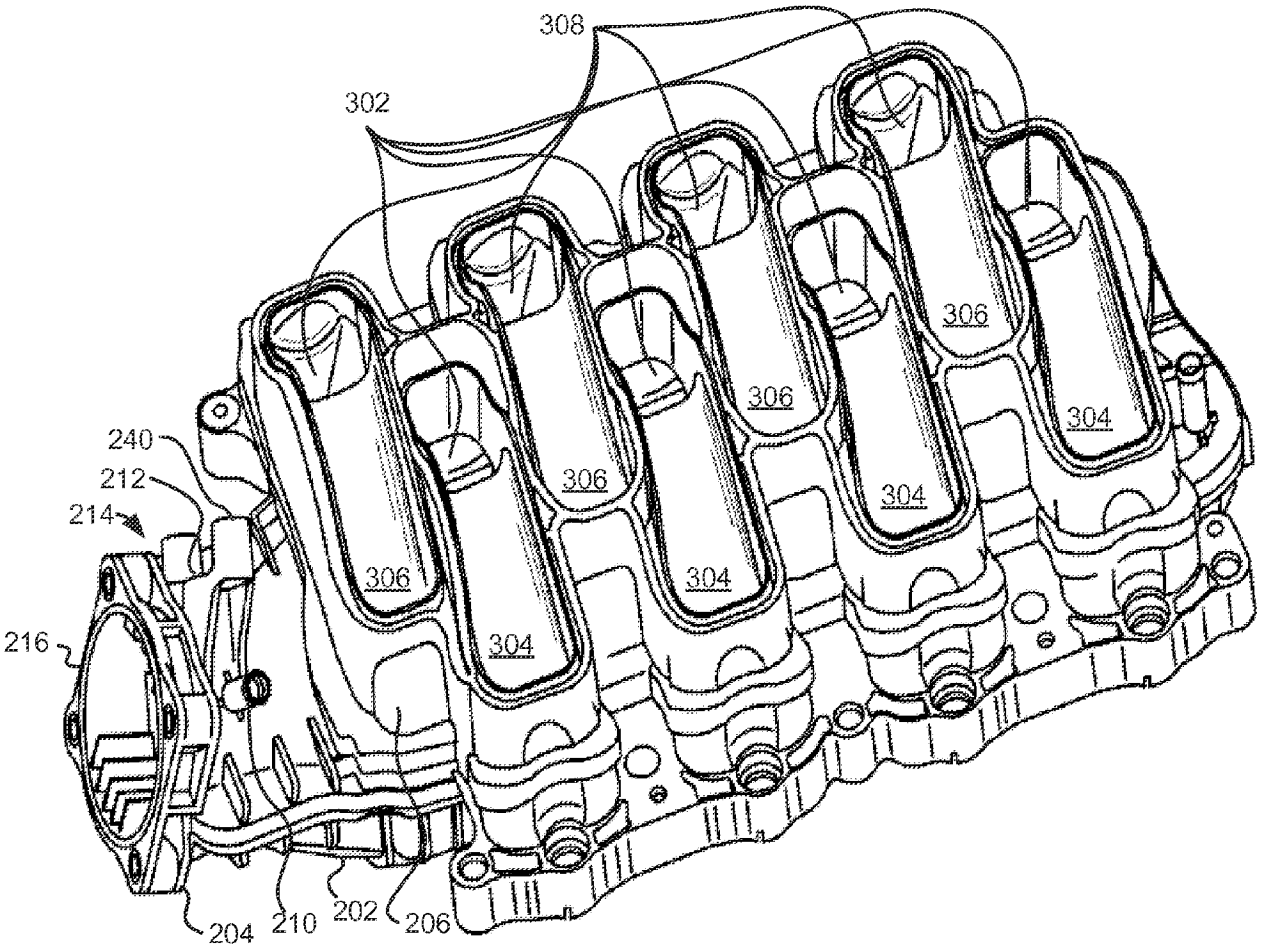
FIG. 3 is a schematic of a partial engine intake manifold assembly.

Referring now to FIG. 3, a schematic of a partial engine intake manifold assembly is shown. In particular, FIG. 3 illustrates the intake manifold assembly 44 of FIG. 2 without intake manifold upper shell 208. Intake manifold plenum shell 202, intake manifold lower shell 204, and intake manifold middle shell 206 are shown as in FIG. 1. FIG. 3 shows intake runner inlet ports 302 and 306 from which air is drawn from the intake air collector to intake runner outlets 304 and 308. Intake runner outlets 304 and 308 supply air to cylinder bank numbers 1 and 2. Intake runner outlets 304 and 308 are arranged in parallel. Brake boost port 210, fuel purge port 212, PCV port 214, and PCV valve mounting bosses 240 are shown as in FIG. 2.

Figure 4:
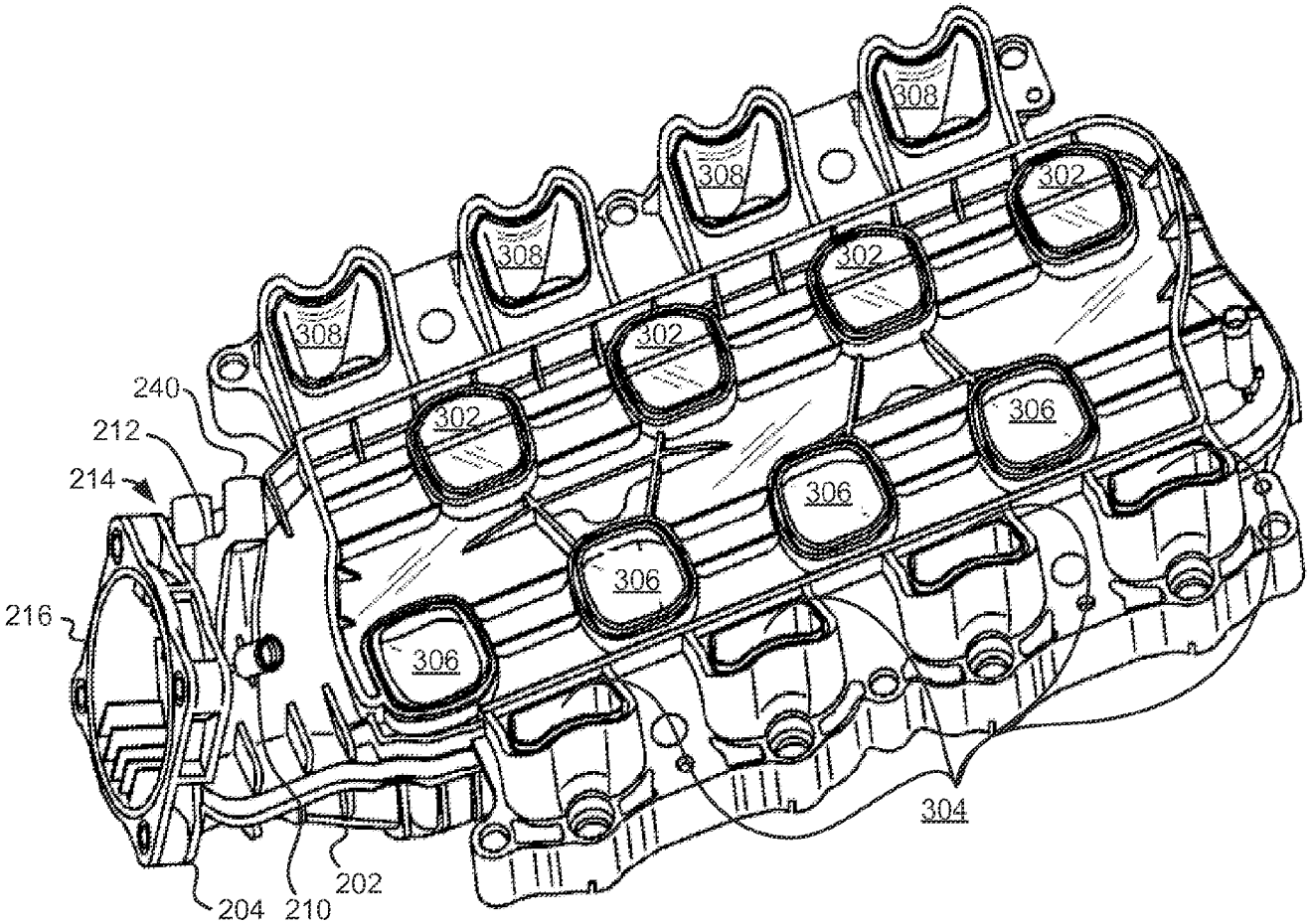
FIG. 4 is a schematic of a partial engine intake manifold assembly.

Referring now to FIG. 4, a schematic of a partial engine intake manifold assembly is shown. In particular, FIG. 4 illustrates the intake manifold assembly 44 of FIG. 2 without intake manifold upper shell 208 and intake manifold middle shell 206. Intake manifold lower shell 204 includes the end sections of intake runner outlets 304 and 308 as well as beginning sections of intake runner inlet ports 302 and 306. Brake boost port 210, fuel purge port 212, PCV port 214, and PCV valve mounting bosses 240 are shown as in FIG. 2.

Figure 5:
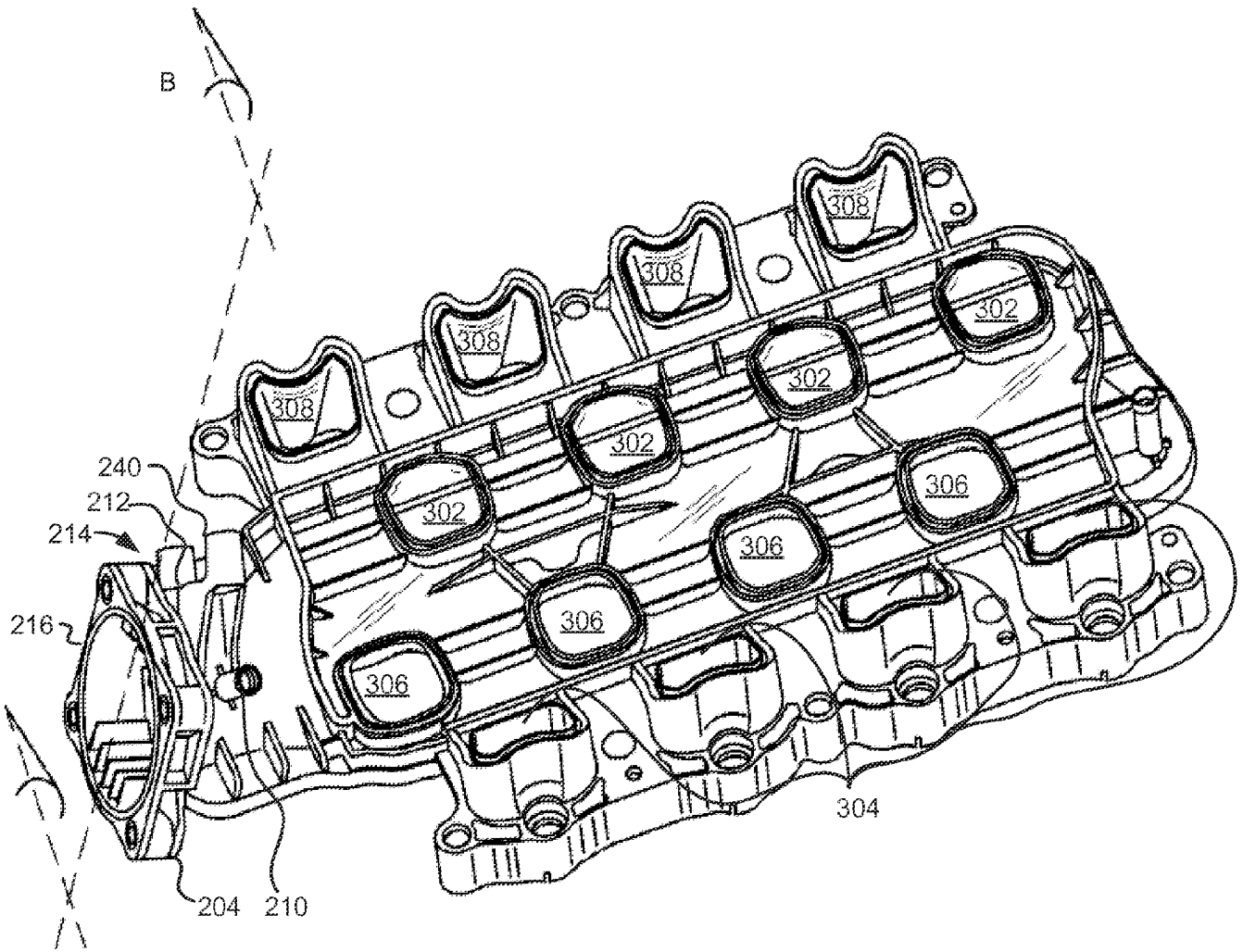
FIG. 5 is a schematic of one component of an engine intake manifold assembly.

Referring now to FIG. 5, a schematic of one component of an engine intake manifold assembly is shown. In particular, intake manifold lower shell 204 is shown separated from intake manifold plenum shell 202. The top of intake manifold lower shell 204 is shown as oriented when coupled to an engine. Thus, intake manifold lower shell comprises the upper portion of an intake air collector show in cross-section at FIG. 8. Cutting plane B identifies the basis for sectional views shown in FIGS. 9-10. Brake boost port 210, fuel purge port 212, PCV port 214, and PCV valve mounting bosses 240 are shown as in FIG. 2.

Figure 6:
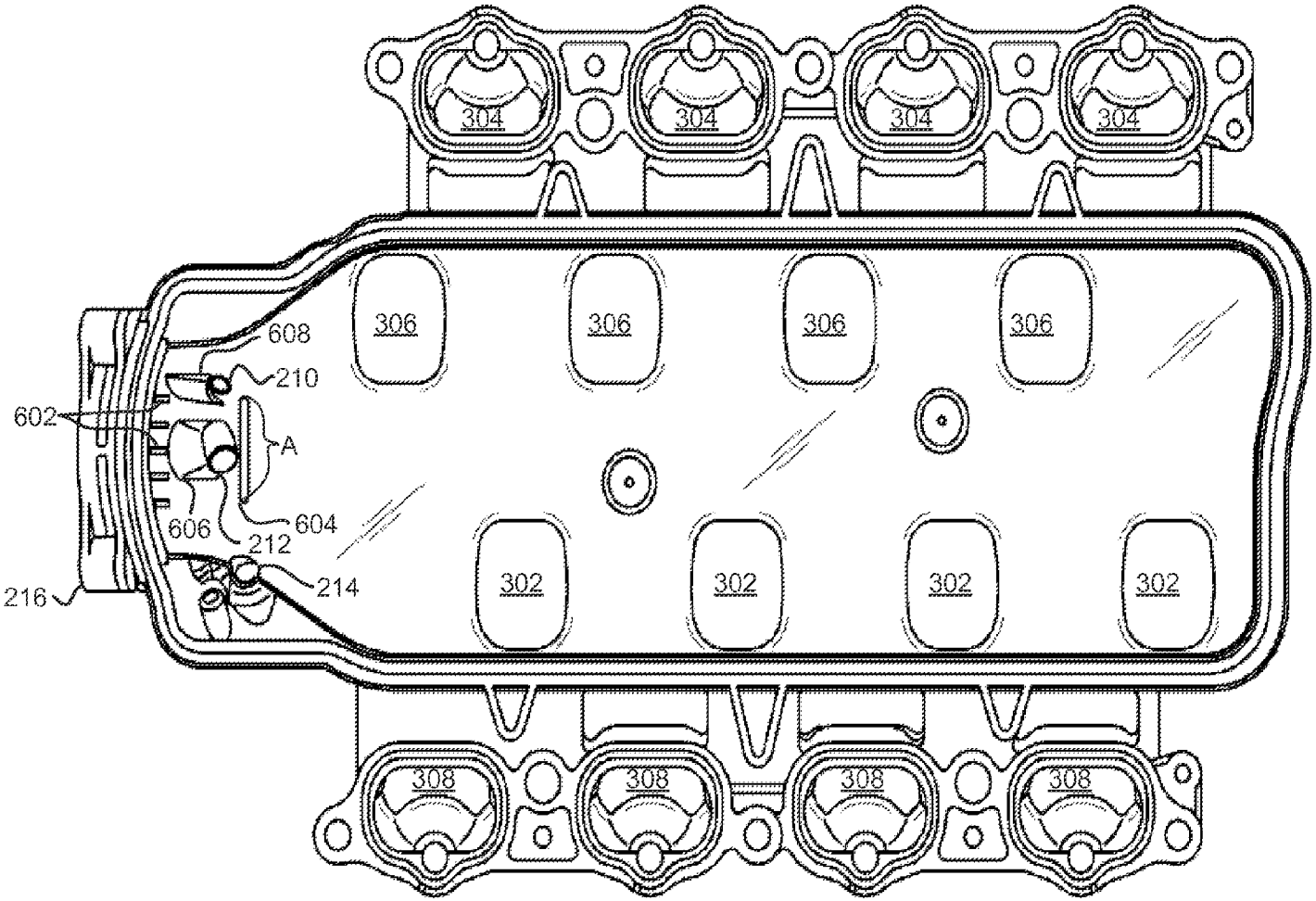
FIG. 6 is a bottom view of one component of an engine intake manifold assembly.

Referring now to FIG. 6, a bottom view of one component of an engine intake manifold assembly is shown. In particular, the bottom side of intake manifold lower shell 204 is shown. Throttle body mounting flange 216 is shown at the left side of FIG. 6. As air enters the intake assembly from a throttle body (not shown) coupled to throttle body mounting flange 216 it passes anti-whoosh vanes 602 which reduce noise from air entering the intake manifold. Thus, from this view, if the intake manifold were assembled, air enters from the left side of intake manifold lower shell 204 and leaves the intake air collector through ports 302 and 306 into intake runners (not shown).

Fuel purge port 212 and brake boost port 210 are located between throttle body mounting flange 216 and intake manifold runner inlet ports 302 and 306. Fuel purge port ramp 606 and brake boost port ramp 608 lie between anti-whoosh vanes 602 and brake boost port 210 and fuel purge port 212. Purge port wall 604 is positioned at the bottom of intake manifold lower shell 204 which comprises the top of the intake air collector when the intake manifold assembly is coupled to an engine mounted in a vehicle. Intake runner outlets 304 and 308 are arranged in parallel to intake manifold runner inlet ports 302 and 306.

The length of purge port wall 604 is shown three times the diameter B of fuel purge port 212. However, in other embodiments the length of purge port wall 604 may be as small as one-tenth of the diameter B of fuel purge port 212 or as large as the inner diameter of the intake manifold at the location of the purge port wall 604. In the present example, the outside edge of fuel purge port 212 is located with 2 mm of purge port wall 604. However, in other embodiments the fuel purge port 212 may be located up to 6 cm from the purge port wall 604. In one example, the center of purge port wall 604 and the center of fuel purge port 212 are in alignment. However, in some embodiments the center of fuel purge port 212 may be located as far out as to one end of either end of purge port wall 604. The center of fuel purge port 212 and the center of purge port wall 604 are located centrally between intake runner inlet ports 302 and 306. By placing fuel purge port 212 and purge port wall 604 between the rows formed by intake runner inlet ports 302 and 306, fuel vapors entering the intake manifold via fuel purge port 212 may be substantially evenly distributed between cylinder banks that are provide air to engine cylinders by way of intake runner inlet ports 302 and 306.

Figure 7:
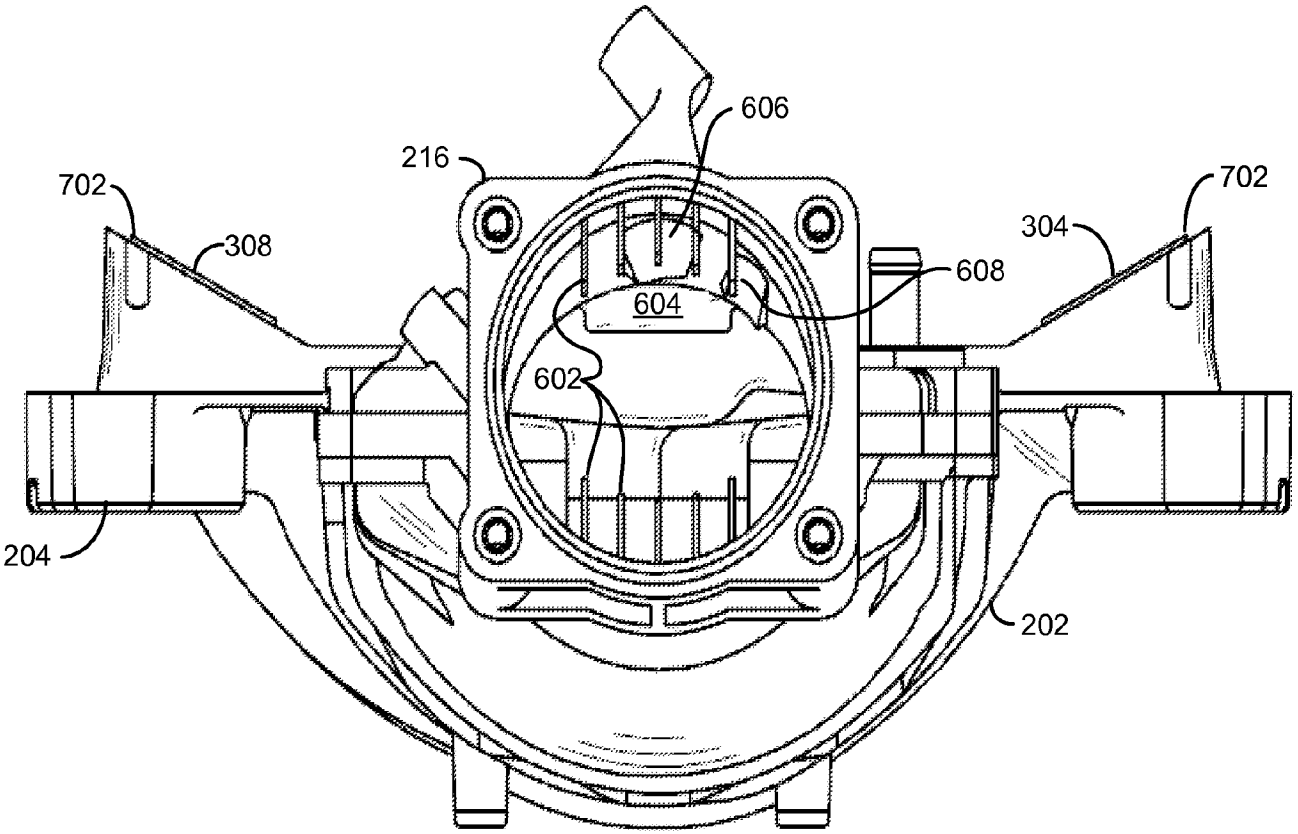
FIG. 7 is a front view of two components of an engine intake manifold assembly.

Referring now to FIG. 7, a front view of two components of an engine intake manifold assembly is shown. Specifically, intake manifold plenum shell 202 and intake manifold lower shell 204 are shown from the front side where air enters the intake manifold assembly 44 via a throttle mounted to throttle body mounting flange 216.

Air entering intake manifold assembly 44 first encounters anti-whoosh vanes 602. In one embodiment, anti-whoosh vanes may be from 5-25 mm in length. Anti-whoosh vanes 602 are shown evenly spaced and are placed on the upper and lower sides of intake manifold lower shell 204. However, anti-whoosh vanes 602 may be placed on the left and right sides of intake manifold lower shell 204 in some embodiments. Air entering intake manifold assembly 44 from a throttle body and following the top or roof of the intake manifold assembly next encounters the fuel purge port ramp 606 and brake boost port ramp 608. In one example, the height of purge port ramp 606 and brake boost port ramp 608 are one half the diameters of the respective fuel purge port 212 and brake boost port 210. In other embodiments, the height of purge port ramp 606 and brake boost port ramp 608 may range from one quarter to three quarters of the diameters of the respective purge fuel port 212 and brake boost port 210. The purge port ramp 606 and brake boot ramp 608 reduce whistling sounds that may be caused when air flows over the fuel purge port 212 and the brake boost port 210. Air flowing from the throttle body may encounter fuel vapors that may be flowing into the intake manifold assembly by way of the fuel purge port 212 located behind purge port ramp 606. The fuel vapors and air collide with purge wall (or alternatively protrusion) 604. Purge wall 604 follows the curvature of the intake manifold lower shell 204 and extends outward from the top or roof of intake manifold lower shell such that the outward edge of purge wall 604 forms a horizontal edge referenced to the position of the intake manifold assembly as oriented in an engine and vehicle. However, in alternative embodiments the purge wall may be formed at locations in the intake manifold other than the roof (e.g., a side wall or bottom of the intake manifold). In the present example, right and left edges of purge wall 604 extend in a vertical direction back from the horizontal edge to the top of intake manifold lower shell 204. Thus, right angles form the extent or ends of the purge wall 604 while the top of purge wall follows the arc of the top or roof of intake manifold lower shell 204.

FIG. 7 also shows locations of intake runner joints 702 for matching intake runners between intake manifold sections. Intake runner outlets 304 and 308 are mated to intake manifold middle shell 206 at intake runner joints 702. Intake manifold lower shell 204 is bolted to engine cylinder heads when coupled to an engine.

Figure 8:
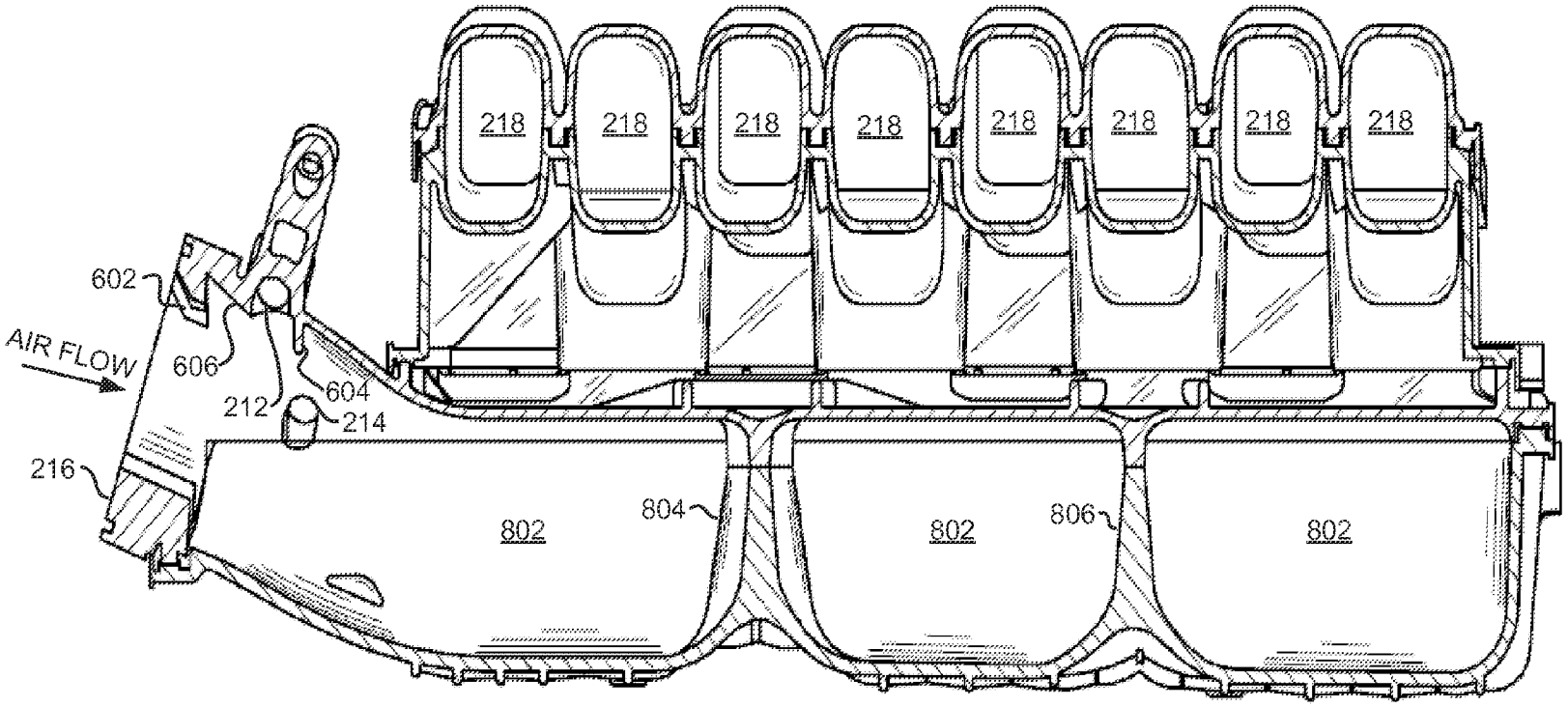
FIG. 8 is a cross-sectional view of an engine intake manifold assembly.

Referring now to FIG. 8, a cross-sectional view of an engine intake manifold assembly is shown. In particular, cross-section A of intake manifold assembly 44 is shown. Intake manifold collector or plenum 802 is located in the lower portion of intake manifold assembly 44. Intake manifold collector 802 is formed by intake manifold plenum shell 202 and intake manifold lower shell 204. Vertical support members 804 and 806 limit the deflection of intake manifold collector 802 but the intake manifold is not bifurcated by the support members. However, in some examples the intake manifold collector may be divided into two separate sections. When the engine rotates air is drawn from intake manifold collector 802 through intake runners 218 and into engine cylinders.

FIG. 8 also shows the position of anti-whoosh vanes 602, fuel purge port ramp 606, and purge port wall 604 relative to throttle body mounting flange 216 and fuel purge port 212.

Figure 9:
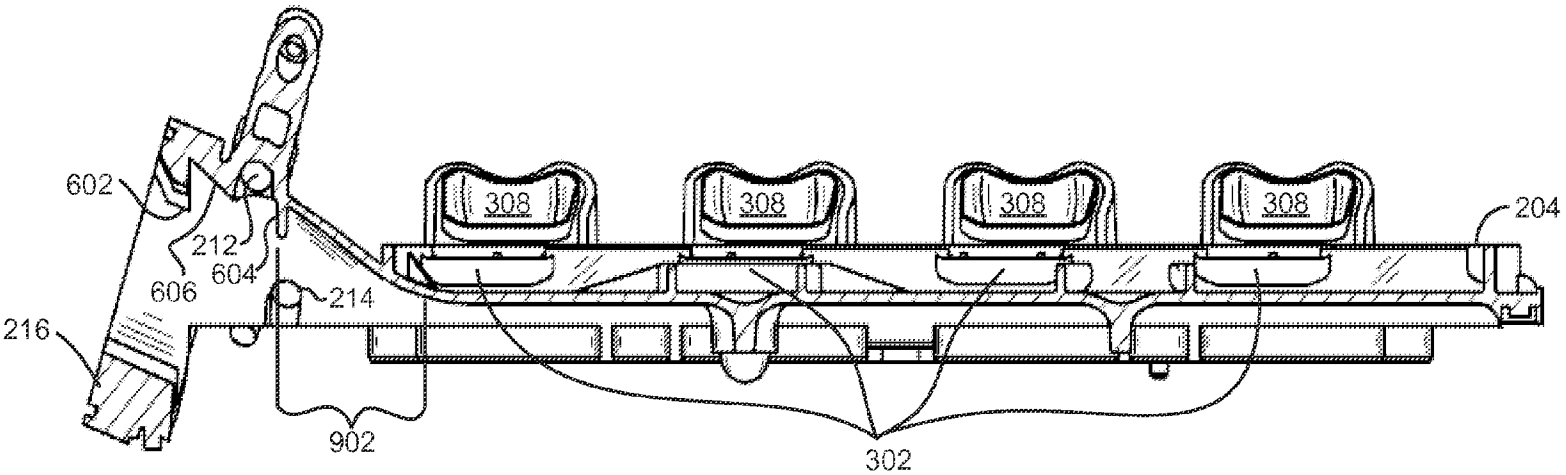
FIG. 9 is a cross-sectional view of an engine intake manifold assembly component.

Referring now to FIG. 9, a cross-sectional view of an engine intake manifold assembly component is shown. In particular, a cross-section of lower shell 202 along the direction of section B of FIG. 5 is shown. The cross-section shows the locations of intake runner outlets 308 relative to the throttle body mounting flange 216, the anti-whoosh vanes 602, the purge port ramp 606, and the purge wall 604. The location of intake runner inlets 302 relative to purge port wall 604 shows a mixing zone 902 where fuel vapors can mix with air entering the intake manifold by way of the throttle body flange 216 opening. The length of mixing zone 902 can vary with different manifold designs. In some applications the mixing zone may be as little as 5 mm, while in other applications the mixing zone may be as long as 20 cm. The distance between fuel purge port 212 and purge port wall 604 may vary between 2 mm and 5 cm (e.g., 5 mm, 10 mm, 15 mm, 20 mm, 25 mm, 30 mm, 35 mm, 40 mm) depending on application. The locations of intake runner outlets 308 are also shown for reference.

Figure 10:
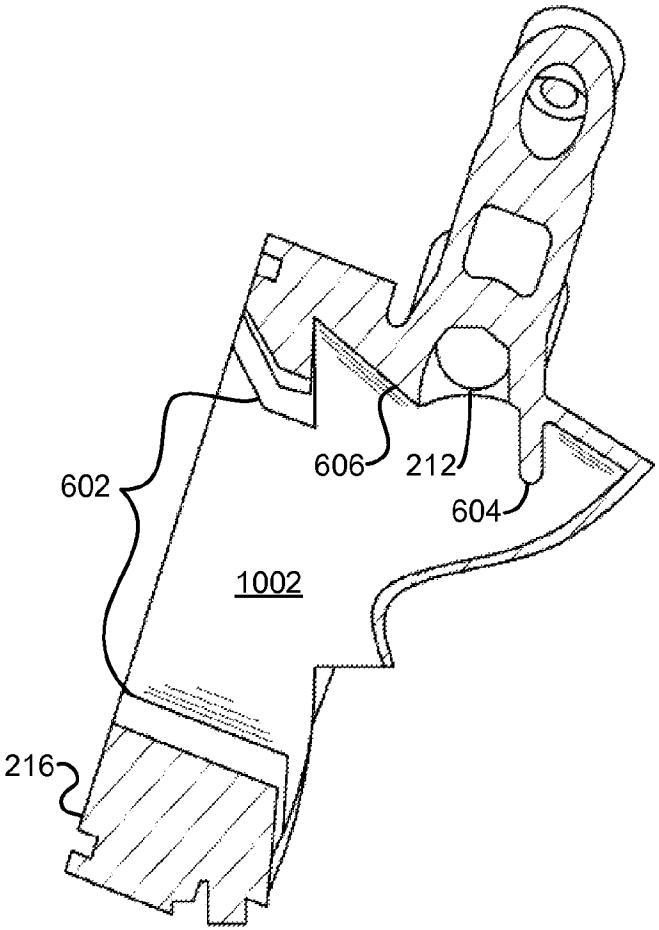
FIG. 10 is a detailed cross-sectional view of an engine intake manifold assembly.

Referring now to FIG. 10, a detailed cross-sectional view of an engine intake manifold assembly is shown. Specifically, a detailed view of the inlet portion of intake manifold lower shell 204 is shown.

Throttle body flange 216 forms the inlet to the intake manifold assembly 44 shown in FIG. 2. Anti-whoosh vanes are formed in intake manifold lower shell 204 and extend into the throat area of intake manifold lower shell 204 which follows the throttle body flange 216 in the direction of air flow into the intake manifold. Anti-whoosh vanes may vary in length from 5-95 mm. Fuel purge port ramp 606 and brake boost port ramp 608 (not shown) are set at an angle B that may vary between 5°-65° (e.g., 10°, 15°, 20°, 25°, 30°, 35°, 40°, 45°, 50°, 55°, 60°) relative to the angle of intake manifold throat 1002. The height of purge wall 604 varies for different applications in a range of 5-15 mm. In some embodiments where no fuel purge port ramp 606 is included, the height of purge wall 604 may be reduced (e.g., 3-8 mm). In embodiments where fuel purge port ramp 606 is included, fuel purge port wall 604 extends past the height of fuel purge port ramp 606. Thus, when air enters the intake manifold it flows over fuel purge port ramp 606 and the hits purge wall 604 creating turbulence, thereby mixing fuel vapors with fresh air entering the engine.

It should be noted that in this embodiment PCV port 214 does not include a PCV ramp between throttle body mounting flange 216 and PCV port 214, nor is a PCV wall shown between PCV port and intake runner inlet port 302. However, in other embodiments a PCV ramp and PCV wall may be included. The PCV wall may be positioned between the PCV port and intake runner inlet ports 302. In addition, in some embodiments only a PCV ramp may be included. While in other embodiments a PCV wall without a PCV ramp may be included. The PCV ramp and PCV wall may be constructed with constraints similar to fuel purge wall 604 and fuel purge port ramp 606.

Thus, FIGS. 2-10 provide for an intake manifold, comprising: a non-partitioned intake manifold coupled to an engine and including a common collector to which a plurality of intake runners are coupled; a first port located in said intake manifold and in an air flow path downstream of a throttle body and upstream of said plurality of intake runners; and a protrusion into said intake manifold downstream of said port and upstream of said plurality of intake runners. The protrusion may be oblong and where a long side of said protrusion is perpendicular to flow of gases from said port. The intake manifold also provides for a ramp that is located in said intake manifold upstream of said first port and said protrusion, said ramp at an angle of between 5 and 65 degrees. The intake manifold also provides for a first port that is located in a throat of a second port, said second port having a larger diameter than said first port, an where vanes extend into the throat of said second port. The intake manifold also provides for protrusion that is formed as part of said intake manifold, and where said intake manifold is comprised of at least three sections coupled together, and where intake runners couple said common collector to two engine cylinder heads, and where said protrusion is formed in the top of said common collector at a location with a mixing zone of at least 2 cm in length from said protrusion to a first intake runner inlet. The intake manifold also provides for an intake manifold that is configured to deliver said air to first and second banks of cylinders, and where said intake manifold provides mounting bosses for a purge valve that interfaces to said first port, and where said first port is located within the top half of a throat of said intake manifold, and where intake runners are arranged in a first row and a second row, the first and second rows aligned in parallel, and where said first port is located between said first and second rows. The intake manifold also provides for intake manifold that includes a plurality of bell mouths leading said plurality of intake runners, and where said protrusion includes a long side that is perpendicular to first and second rows of intake runner inlets.

Thus, FIGS. 2-10 provide for an engine intake manifold, comprising: a first port located in said intake manifold and in an air flow path downstream of a throttle body and upstream of a plurality of runners; and a protrusion from a wall of said intake manifold, a length of said protrusion less than a diameter of said intake manifold where said protrusion is located, said protrusion located downstream of said first port and upstream of said plurality of runners. The intake manifold also provides for a protrusion is in a roof of said intake manifold and said runners are intake runners. The intake manifold also provides for roof that is an upper ⅓ of said intake manifold relative to a position of a vehicle, and where a ramp is located in said intake manifold upstream of said first port and said protrusion, said ramp at an angle of between 5 and 65 degrees. The intake manifold also provides for a protrusion is oblong and where a long side of said protrusion is perpendicular to a flow of gases from said port. The intake manifold also provides for a first port is located in a throat of a second port, said second port having a larger diameter than said first port, an where vanes extend into the throat of said second port. The intake manifold also provides for a port that is located centrally between ends of said protrusion, where said intake manifold is configured to deliver said air to first and second banks of cylinders, and where said intake manifold provides mounting bosses for a purge valve that interfaces to said first port, and where said first port is located within the top half of a throat of said intake manifold, and where intake runners are arranged in a first row and a second row, the first and second rows aligned in parallel, and where said first port is located between said first and second rows. The intake manifold also provides for a second protrusion is located upstream of said port. The intake manifold also provides for a first port is configured to provide gases to said intake manifold, and where said intake manifold includes a plurality of bell mouths leading said plurality of intake runners, and where said protrusion includes a long side that is perpendicular to first and second rows of intake runner inlets. The intake manifold also provides for a second port, said second port configured to supply vacuum to a device outside of said intake manifold.

Figure 11:
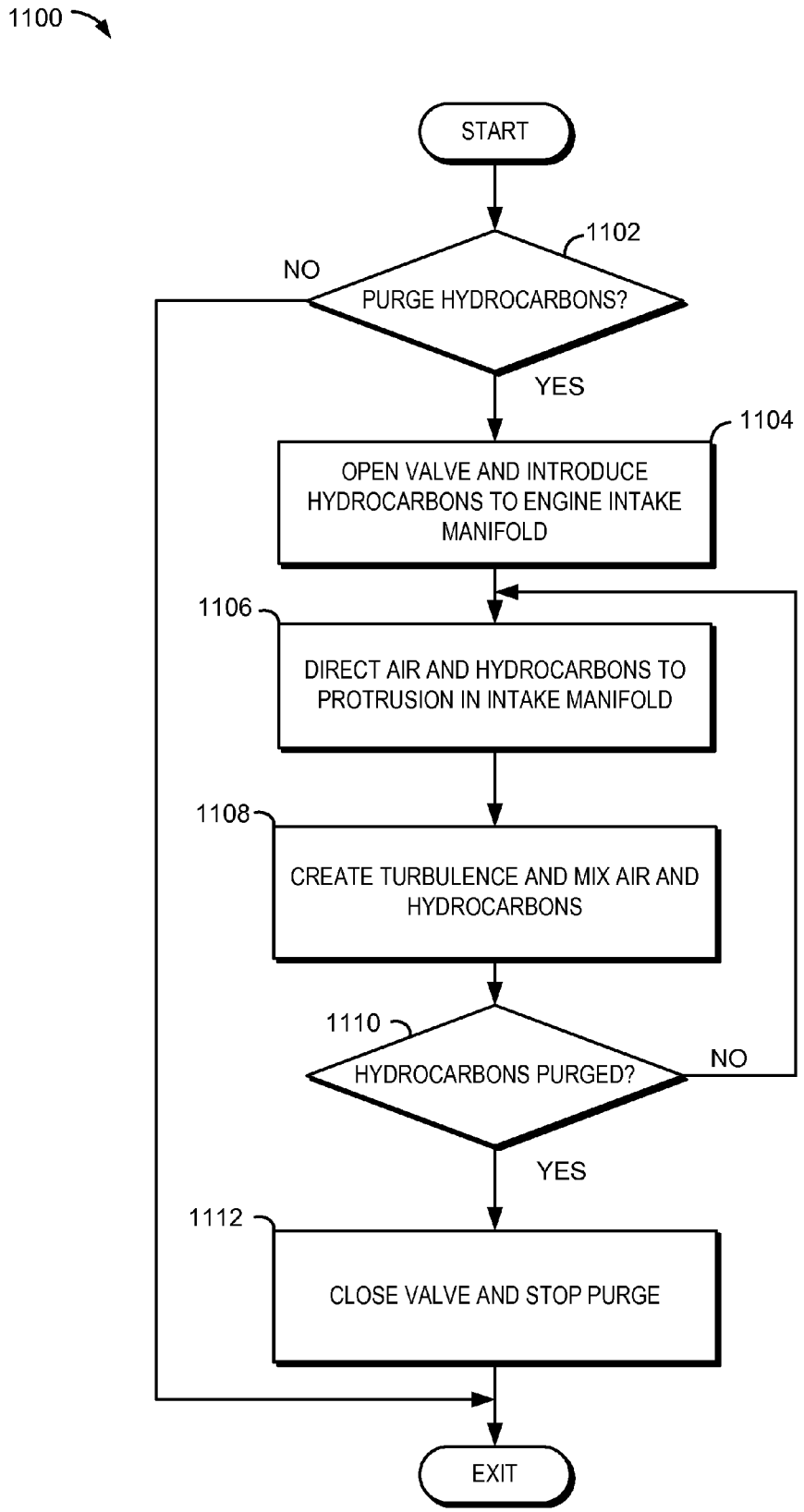
FIG. 11 is a method for introducing gases to an engine intake manifold.

Referring now to FIG. 11, a method for introducing gases to an engine intake manifold is shown. Routine 1100 begins at 1102 where it is judged whether or not hydrocarbon vapors are to be purged into the engine. In one embodiment, hydrocarbons may originate from a fuel storage tank. In another embodiment, hydrocarbons may originate from the engine crankcase or from a carbon canister. Routine 1100 may judge to purge hydrocarbons when the estimated storage capacity of a hydrocarbon storage vessel reaches a predetermined amount. In another embodiment, routine 1100 may judge to purge hydrocarbons in response to engine operating conditions. For example, routine 1100 may judge to purge hydrocarbons when engine load is greater than a first threshold and less than a second threshold. If it is judged to purge hydrocarbons routine 1100 proceeds to 1104. Otherwise, routine 1100 proceeds to exit.

At 1104, routine 1100 opens a valve that allows hydrocarbons to flow from a source to the engine intake manifold. In one example, the valve may allow hydrocarbons to flow from a canister. In another example, the valve may allow engine crankcase vapors to flow from the engine crankcase to the engine intake manifold (e.g., a PCV valve). In yet another example, hydrocarbons may flow from a fuel storage tank to the engine intake manifold (e.g., a fuel vapor purge valve). In some embodiments, the position of the valve is controlled in response to engine operating conditions. For example, the valve position may be controlled in response to engine speed and engine load. Further, the valve position may be controlled in response to the concentration of hydrocarbons stored in a storage vessel as well as engine speed and engine load. Routine 1100 proceeds to 1106 after adjusting the valve.

At 1106, routine 1100 directs a mixture of hydrocarbons and air through an intake manifold (e.g., the intake manifold of FIGS. 2-10). In particular, at least a portion of air and hydrocarbons entering an intake manifold is directed to a protrusion in the intake manifold (e.g., 604 of FIG. 6). In one example, the air and hydrocarbons are directed at an oblong protrusion. In particular, the direction of air flow and hydrocarbon flow is perpendicular to the long side of the oblong protrusion. When the air and hydrocarbons encounter the protrusion at least a portion of the air and hydrocarbons are directed around the protrusion. Another portion of the air and hydrocarbons may be directed over the protrusion. Air and hydrocarbons are directed at the protrusion by placing the protrusion in the flow path. Of course, different shapes may be substituted for the oblong shape if desired. For example, a V may be inserted in the intake manifold with the point of the V pointing in a direction of the purge or PCV port. In another example, a circular shaped protrusion may be substituted for the oblong protrusion in order to reduce air drag in the intake manifold. For example, a dowel rod or similarly shaped protrusion may extend from the intake manifold in the flow path of hydrocarbons and air.

At 1108, routine 1100 initiates turbulence around the protrusion to improve hydrocarbon and air mixing. The amount and pattern of turbulence may be varied depending on engine configuration. For example, in one engine an oblong protrusion into the intake manifold may provide a desired level of turbulence at an acceptable level of air drag. In another example, a circular protrusion may provide a little less turbulence but may also reduce air drag in the intake manifold. Thus, depending on design objectives, different structures may be selected for different applications.

At 1110, routine 1100 judges whether or not hydrocarbons are purged. In one example, hydrocarbons may be judged purged from sensing an exhaust gas oxygen concentration level. In another example, hydrocarbons may be judged purged when a pressure of a hydrocarbon storage vessel is less than a predetermined amount. If hydrocarbons are judged purged, routine 1100 proceeds to 1112. Otherwise, routine 1100 returns to 1106.

At 1112, routine 1100 closes the valve and stops purging of hydrocarbons. In some examples the valve may be closed in a step-wise manner. In other examples the valve may be gradually closed so as to reduce the rate of change in the engine air-fuel mixture. Once the valve is closed and purging of hydrocarbons is stopped, routine 1100 proceeds to exit.

Thus, the method of FIG. 11 provides for a method for distributing gases in an intake manifold, comprising: selectively introducing gases into said intake manifold by way of a port; passing said gases over or around an oblong protrusion in said intake manifold, a length of a longer side of said oblong protrusion less than a diameter of said intake manifold where said oblong protrusion is located; and increasing turbulence of said gases to improve distribution of said gases within said intake manifold. The method provides for an oblong protrusion that is located downstream of said port and upstream of at least one runner of said intake manifold. The method provides for a longer side of said oblong protrusion is perpendicular to a flow path of gases flowing from said port. The method provides for gases that are comprised of fuel vapors.

As will be appreciated by one of ordinary skill in the art, routine described in FIG. 11 may represent one or more of any number of processing strategies such as event-driven, interrupt-driven, multi-tasking, multi-threading, and the like. As such, various steps or functions illustrated may be performed in the sequence illustrated, in parallel, or in some cases omitted. Likewise, the order of processing is not necessarily required to achieve the objects, features, and advantages described herein, but is provided for ease of illustration and description. Although not explicitly illustrated, one of ordinary skill in the art will recognize that one or more of the illustrated steps or functions may be repeatedly performed depending on the particular strategy being used.

This concludes the description. The reading of it by those skilled in the art would bring to mind many alterations and modifications without departing from the spirit and the scope of the description. For example, I3, I4, I5, V6, V8, V10, and V12 engines operating in natural gas, gasoline, diesel, or alternative fuel configurations could use the present description to advantage.

The invention claimed is:

1. An intake manifold, comprising:

a non-partitioned intake manifold including an inlet and a common collector coupled to a plurality of intake runners;

a fuel purge port piercing an intake manifold wall downstream of said inlet;

a brake boost port piercing said intake manifold wall;

a first ramp positioned on said intake manifold wall and upstream of said fuel purge port;

a second ramp positioned on said intake manifold wall and upstream of said brake boost port; and a protrusion formed in said intake manifold wall and positioned downstream of said fuel purge port and said brake boost port, said protrusion extending past a height of said second ramp.

2. The intake manifold of claim 1, where said protrusion is oblong and where a long side of said protrusion is perpendicular to a flow of gases from said fuel purge port, where said first ramp extends from said intake manifold wall into said common collector, and where said second ramp extends from said intake manifold wall into said common collector.

3. The intake manifold of claim 2, where said first ramp is located in said intake manifold upstream of said fuel purge port and said protrusion, said first ramp at an angle of between 5 and 65 degrees.

4. The intake manifold of claim 1, further comprising first and second groups of anti-whoosh vanes positioned upstream of said fuel purge port and said brake boost port, and where said protrusion extends along said intake manifold wall beyond extents of said fuel purge port.

5. The intake manifold of claim 1, where said protrusion is formed as part of said intake manifold, and where said intake manifold is comprised of at least three sections coupled together, and where said protrusion is formed in a top of said common collector at a location with a mixing zone of at least 2 cm in length from said protrusion to a first intake runner inlet.

6. The intake manifold of claim 1, where said intake manifold provides purge valve mounting bosses that interface to said fuel purge port, and where said fuel purge port is located within a top half of a throat of said intake manifold, and where said plurality of intake runners are arranged in a first row and a second row, said first and second rows aligned in parallel, and where said fuel purge port is located between said first and second rows.

7. The intake manifold of claim 6, where said intake manifold includes a plurality of bell mouths leading to said plurality of intake runners, and where said protrusion includes a long side that is perpendicular to said first and second rows of intake runners.

8. An engine intake manifold, comprising:

first and second ports located in said engine intake manifold and in an air flow path downstream of a throttle body mounting flange and upstream of a plurality of runners;

a first ramp located in said engine intake manifold upstream of said first port;

a second ramp located in said engine intake manifold upstream of said second port; and a protrusion from an inside wall of said engine intake manifold, a length of said protrusion being greater than extents of said first port, said protrusion located downstream of said first and second ports and upstream of said plurality of runners, said protrusion having a height that extends past a height of said first ramp.

9. The engine intake manifold of claim 8, where said protrusion is in a roof of said intake manifold and said plurality of runners are intake runners.

10. The engine intake manifold of claim 9, where said roof is an upper ⅓ of said engine intake manifold relative to a position of a vehicle.

11. The engine intake manifold of claim 8, where said protrusion is oblong and where a long side of said protrusion is perpendicular to a flow of gases from said first port.

12. The engine intake manifold of claim 11, where said first port is located centrally between ends of said protrusion, where said second port is offset to one side of said protrusion, and where said intake manifold provides a purge valve mounting boss that interfaces to said first port, and where said first port is located within a top half of a throat of said intake manifold.

13. The engine intake manifold of claim 11, where said first port is positioned between two rows of intake runners in said engine intake manifold.

14. The engine intake manifold of claim 11, where said first port is configured to provide fuel vapor containing gases to said intake manifold, and where said intake manifold includes a plurality of bell mouths leading to said plurality of runners, and where said protrusion includes a long side that is perpendicular to first and second rows of intake runner inlets.

15. The engine intake manifold of claim 8, further comprising first and second groups of anti-whoosh vanes located upstream of said first and second ports.

16. The engine intake manifold of claim 15, where said first and second groups of anti-whoosh vanes are located on a top side and a bottom side of said engine intake manifold.

17. A method for distributing fuel vapor containing gases in an intake manifold, comprising:

selectively introducing fuel vapors into said intake manifold via a first port;

passing air over a first ramp that reduces whistling and combining said air with said fuel vapors;

passing said fuel vapors over or around an oblong protrusion, said oblong protrusion downstream of said first ramp and having a height that extends past a height of the first ramp, and where said oblong protrusion is downstream of a second port and a second ramp; and the second port and the second ramp, said second port providing vacuum outside of said intake manifold, said second ramp upstream of said second port in a direction of air flow into said intake manifold from a throttle body flange.

18. The method of claim 17, where said oblong protrusion is located downstream of said first port and upstream of at least one runner of said intake manifold, and where a length of said oblong protrusion is greater than extents of said first port.

* * * * *